US006694537B2

(12) United States Patent
Telles

(10) Patent No.: US 6,694,537 B2
(45) Date of Patent: Feb. 24, 2004

(54) TOILET SEAL RING

(76) Inventor: Anthony Telles, 9957 France Ave., Tujunga, CA (US) 91042

( * ) Notice: Subject to any disclaimer, the term of this patent is extended or adjusted under 35 U.S.C. 154(b) by 120 days.

(21) Appl. No.: 09/904,058

(22) Filed: Jul. 11, 2001

(65) Prior Publication Data

US 2003/0009820 A1 Jan. 16, 2003

(51) Int. Cl.[7] ..... E03D 11/17

(52) U.S. Cl. ..... 4/252.6; 4/252.5; 4/252.4; 4/252.1

(58) Field of Search ..... 4/252.6, 252.5, 4/252.4, 252.1

(56) References Cited

U.S. PATENT DOCUMENTS 2,427,431 A * 9/1947 Wieland ..... 106/263
3,567,296 A * 3/1971 Suchocki ..... 384/489
3,568,222 A * 3/1971 Gantzert ..... 4/252.5
3,967,326 A * 7/1976 Tammen ..... 285/58
4,482,161 A * 11/1984 Izzi, Sr. ..... 277/606
4,515,398 A * 5/1985 Machon, Sr. ..... 285/12
4,843,835 A * 7/1989 Goetz et al. ..... 62/285
5,018,224 A * 5/1991 Hodges ..... 285/56
5,185,890 A * 2/1993 Dismore et al. ..... 4/252.1
5,597,021 A * 1/1997 Crossdale et al. ..... 141/346
5,988,699 A * 11/1999 Quandt ..... 285/142.1
6,070,910 A * 6/2000 Hodges ..... 285/15
2001/0023505 A1 * 9/2001 Atkins ..... 4/252.6

* cited by examiner

*Primary Examiner*—Gregory Huson
*Assistant Examiner*—Khoa Huynh
(74) *Attorney, Agent, or Firm*—Joseph E. Mueth

(57) ABSTRACT

An annular sealing ring for positioning between the toilet bowel and the surface of the floor. The annular sealing ring is positioned at any of the conventional locations and being shaped in any effective configuration. The annular sealing ring comprises unicellar polyethylene foam characterized by resilience and the ability to recover substantially its original shape and thickness after compression loading.

7 Claims, 1 Drawing Sheet

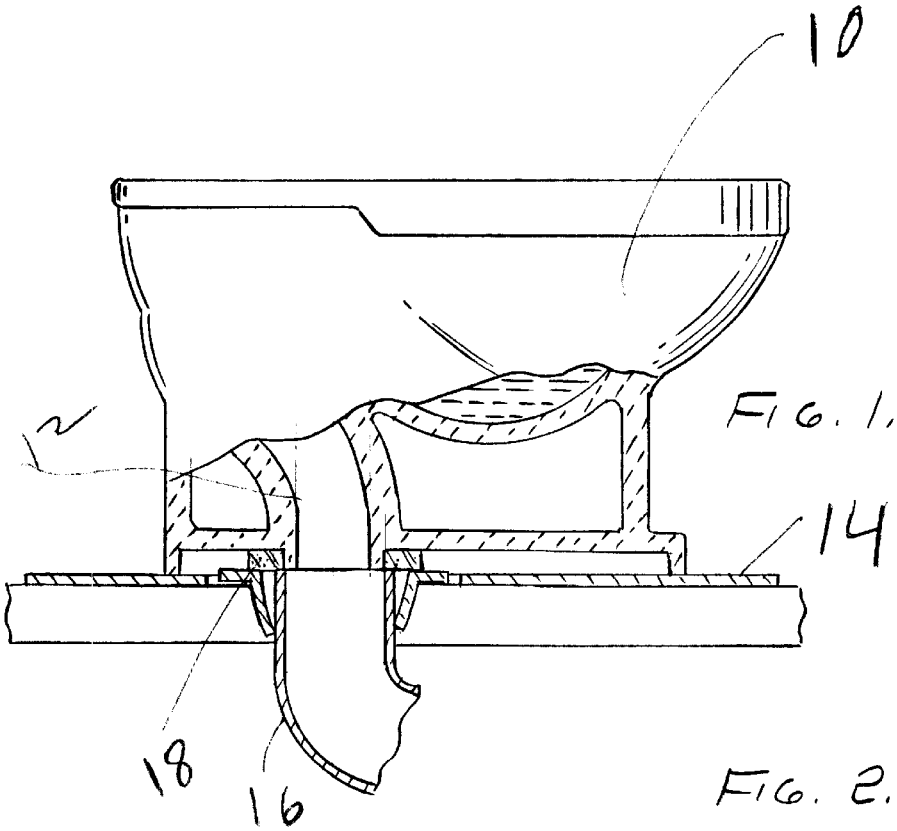
FIG. 1.
FIG. 2.
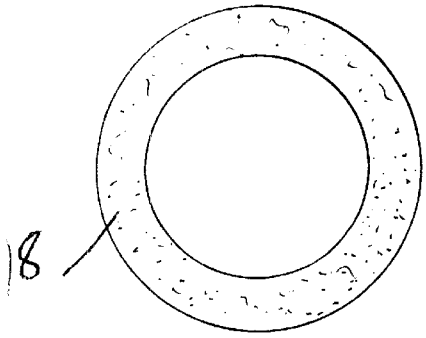
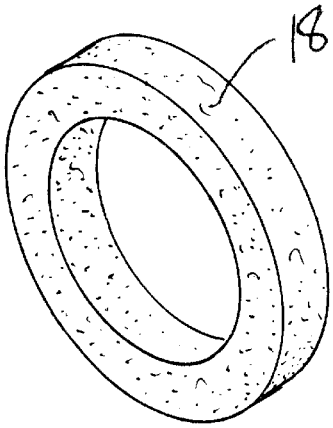
FIG. 3.

TOILET SEAL RING

BACKGROUND OF INVENTION

A floor mounted toilet bowl rests on the surface of the floor. This surface may be wood, concrete or other material. The surface of the flooring in the usual case is not perfectly smooth and consequently it is necessary to provide some type of gasket or sealing material between the bottom of the toilet bowl, or the walls of the outlet of the toilet bowl, and the surface of the floor to prevent leakage and maintain a high degree of sanitation.

Various gaskets and seals have been used or proposed.

A annular wax ring is disclosed in U.S. Pat. No. 3,821, 820. This patent also discloses an annular polyethylene ring.

Typically seals are positioned between the outlet of the toilet bowl and the flanged top surface of the waste or soil pipe extending through an opening in the floor, U.S. Pat. No. 911,486 and U.S. Pat. No. 3,568,222, the latter of which discloses a rubber seal.

In other cases, the seal has been provided by a plumbing fixture setting compound which may be manually applied from bulk, or it may be preformed by molding it into a ring prior to setting the toilet, Federal Specification A-A-3110, July 1997.

The disclosures of the above citations are incorporated herein by reference.

SUMMARY OF INVENTION

Briefly, the present invention comprises a generally annular sealing ring for positioning between the toilet bowel and the surface of the floor, the seal being positioned at any of the conventional locations and being shaped in effective configuration, said annular sealing ring being novel in that it is comprises polyethylene foam characterized by resilience and the ability to recover substantially its original shape and thickness after compression loading.

The invention further includes the combination of a toilet bowl resting on a floor surface wherein a generally annular sealing ring is disposed between said toilet bowl and floor surface with at least some of the weight of the toilet bowl resting on said sealing ring;

the improvement wherein said sealing ring is generally planar, and has inner and outer diameters, and has any effective toilet sealing ring configuration, said annular sealing ring being comprising polyethylene foam characterized by resilience and the ability to recover substantially its original shape and thickness after compression loading.

DESCRIPTION OF PREFERRED EMBODIMENTS

The new toilet seal has excellent application for residential and commercial floor mounted toilets. The seal is basically a material that is waterproof and lightweight. A new material is used for the toilet ring to seal the connection at the floor. The invention makes the job more user friendly and it makes the job cleaner and easier.

The seal material is unicellular extruded polyethylene foam. It is non-biodegradable and very flexible, returning to its original form after use. It can be removed with ease usually in one piece. It is dry unlike a wax ring which is very sticky and messy.

The unicellar polyethylene foam is commercially available from Sealed Air Corporation, Packaging Products Division, 19-01 State Highway 208, Fair Lawn, N.J. These materials are designated by the "Cellu-Cushion" trademark and come in densities of from 1.2 to 2.2 pounds per cubic foot, all of which are applicable to this invention. Other suitable foams also supplied by Seal Air Corporation bear the trademarks "Polyam" and "Plank". These range in density from 1.3 to 9.8 pounds per cubic foot. According to Sealed Air Corporation, these foams are made with the benefit of a flammable hydrocarbon blowing agent which is removed prior to shipment.

THE DRAWINGS

Turning to the drawings:

FIG. 1 is a side elevation view of an outlet for a toilet bowl connected to a pipe extending through a floor and cut away to illustrate an installed gasket embodying the present invention for establishing a seal between the outlet of the toilet bowl and the collar surrounding the inlet end of the connecting pipe.

FIG. 2 is a top plan view of the gasket embodying the present invention.

FIG. 3 is a perspective view of the gasket shown in FIG. 2.

FIG. 1 shows a conventional toilet bowl 10 on a floor surface that includes a conventional outlet 12. Extending through the floor 14 and aligned with the outlet 12 is a conventional soil pipe 16. A closet flange or collar 17 engages the end of the soil pipe 16. The toilet bowl outlet is bolted to the floor.

For sealing the connection of the outlet 12 of the toilet bowl 10 with the closet flange 17 surrounding inlet end of the soil pipe 16 against leakage or seepage of water, moisture, gas, and the like, the gasket 18 embodying the present invention is employed.

This invention is not restricted to any particular dimensions. The seal shown in the illustrative embodiment of the drawings is six inches in outside diameter, and the annular distance between the inside and outside diameters is one and one-eighth inches. The seal is one and one-eighth in thickness.

The seal was made by cutting an end slice from a log-shaped piece of Cellu-Cushion foam. The slice was then hand cut to the shape shown in the drawings.

The embodiment depicted in the drawings is intended to serve as a gasket seal between the surface of the floor and the closet flange with at least some of the weight of the toilet resting on the seal.

The closet flange 17 may or may not be present. If present, the flange portion 19 is usually approximately flush with the surrounding floor surface and for purposes of this invention, the flange portion 19 is deemed part of the floor surface. If the closet flange is not used, the seal 18 is simply sandwiched between the bottom of the toilet bowl and the floor surface.

The gasket or sealing ring 18 has an inner diameter 20, an outer diameter 22 and a thickness 24.

The resilient seal of this invention is particularly advantageous in this situation. In setting a toilet bowl, the seal is positioned on the floor around the opening in the floor, the toilet bowl is then placed on the seal and a good seal is obtained even on uneven surfaces.

It has been found that if the toilet has to be re-set, the bowl can be raised and the seal removed in one piece. Further, the seal regains its original shape and can be used when re-setting.

The Testing

Actual field tests.

The novel seal has been tested on several occasions, both commercial and residential, with floor mounted toilets. A toilet resting on the seal on a concrete slab floor tested with no leaks. On a linoleum floor in an upstairs toilet, the seal tested with no leaks. Two ceramic floor tile applications had no leaks. Two raised foundation, wooden floor toilet applications had no leaks.

In some instances the toilet rocked before it was set. After using the toilet ring of this invention, there was no rocking at all, indicating that a seal had made, that is, the seal had conformed to the irregular surfaces of the floor.

Heat Tests

The toilet ring was placed in an oven for 10 minutes at 180° F. After 10 minutes it was removed and allowed to cool. It took about10 minutes to completely cool, and it was found to have retained its shape.

The claims describe the invention.

What is claimed is:

1. A generally planar annular sealing ring having inner and outer diameters and adapted for positioning between a toilet bowel and a floor surface on which said toilet bowl rests, said annular sealing ring being shaped in any effective toilet sealing ring configuration, said annular sealing ring comprising polyethylene foam characterized by resilience and the ability to recover substantially its original shape and thickness after compression loading.

2. The annular sealing ring of claim 1 wherein said polyethylene foam is unicellular, non-biodegradable and heat resistant.

3. The annular sealing ring of claim 1 wherein the sealing ring is about six inches in outside diameter.

4. The annular sealing ring of claim 1 wherein said sealing ring has an annular distance between said inside and outside diameters of about one and one-eighth inches.

5. The annular sealing ring of claim 1 wherein said sealing ring has a thickness about one and one-eighth inches.

6. An improvement in the combination of a toilet bowl resting on a floor surface wherein a generally annular sealing ring is disposed between said toilet bowl and the floor surface with at least some of the weight of the toilet bowl resting on said sealing ring;

said improvement residing in said annular sealing ring comprising polyethylene foam characterized by resilience and the ability to recover substantially its original shape and thickness after compression loading.

7. The combination of claim 6 wherein said polyethylene foam is unicellular, non-biodegradable and heat resistant.

* * * * *